US006926081B2

(12) United States Patent
Sweatman et al.

(10) Patent No.: US 6,926,081 B2
(45) Date of Patent: Aug. 9, 2005

(54) METHODS OF DISCOVERING AND CORRECTING SUBTERRANEAN FORMATION INTEGRITY PROBLEMS DURING DRILLING

(75) Inventors: Ronald E. Sweatman, Montgomery, TX (US); Richard F. Vargo, Jr., Katy, TX (US); David S. Kulakofsky, Katy, TX (US); Alvaro Escorcia, Sugarland, TX (US); Krishna M. Ravi, Kingwood, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 220 days.

(21) Appl. No.: 10/082,459

(22) Filed: Feb. 25, 2002

(65) Prior Publication Data

US 2003/0162670 A1 Aug. 28, 2003

(51) Int. Cl.[7] ..... E21B 47/10; E21B 33/13

(52) U.S. Cl. ..... 166/250.08; 166/292; 166/294; 166/295; 166/305.1; 175/72; 175/48; 175/50; 73/152.54; 73/152.55

(58) Field of Search ..... 166/250.08, 292, 166/294, 295, 305.1; 73/152.54, 152.55; 175/72, 48, 50

(56) References Cited

U.S. PATENT DOCUMENTS

| | | | | |
|---|---|---|---|---|
| 3,615,794 A | * | 10/1971 | Nimerick | 523/130 |
| 3,960,082 A | | 6/1976 | Sloevsky et al. | 102/22 |
| 4,173,999 A | * | 11/1979 | Messenger | 166/293 |
| 4,434,848 A | | 3/1984 | Smith | 166/250 |
| 4,498,995 A | | 2/1985 | Gockel | 252/8.5 LC |
| 4,714,115 A | | 12/1987 | Uhri | 166/308 |
| 4,718,490 A | | 1/1988 | Uhri | 166/281 |
| 4,836,940 A | * | 6/1989 | Kan et al. | 507/119 |
| 5,180,020 A | | 1/1993 | Fuh et al. | 175/72 |
| 5,207,282 A | | 5/1993 | Fuh et al. | 175/72 |
| 5,222,048 A | * | 6/1993 | Grosso et al. | 367/32 |
| 5,253,709 A | | 10/1993 | Kendrick et al. | 166/284 |
| 5,275,041 A | | 1/1994 | Poulsen | 73/155 |
| 5,335,726 A | | 8/1994 | Rodrigues | 166/295 |
| 5,358,051 A | | 10/1994 | Rodrigues | 166/295 |
| 5,472,049 A | | 12/1995 | Chaffee et al. | 166/250.1 |
| 5,482,116 A | | 1/1996 | El-Rabaa et al. | 166/250.1 |
| 5,497,831 A | | 3/1996 | Hainey et al. | 166/308 |
| 5,555,945 A | * | 9/1996 | Schultz et al. | 175/50 |
| 5,836,392 A | | 11/1998 | Urlwin-Smith | 166/295 |
| 5,868,030 A | | 2/1999 | Brumley et al. | 73/784 |
| 5,873,413 A | | 2/1999 | Chatterji et al. | 166/293 |
| 5,881,826 A | | 3/1999 | Brookey | 175/72 |
| 5,890,536 A | | 4/1999 | Nierode et al. | 166/284 |
| 5,913,364 A | | 6/1999 | Sweatman | 166/281 |
| 5,934,377 A | | 8/1999 | Savage | 281/392 |
| 5,945,387 A | | 8/1999 | Chatterji et al. | 507/224 |
| 6,060,434 A | | 5/2000 | Sweatman et al. | 507/216 |
| 6,123,159 A | | 9/2000 | Brookey et al. | 175/72 |
| 6,148,917 A | | 11/2000 | Brookey et al. | 166/301 |
| 6,156,708 A | | 12/2000 | Brookey et al. | 507/102 |
| 6,167,967 B1 | | 1/2001 | Sweatman | 166/281 |
| 6,186,230 B1 | | 2/2001 | Nierode | 166/250.1 |
| 6,189,612 B1 | * | 2/2001 | Ward | 166/250.07 |
| 6,192,986 B1 | | 2/2001 | Urlwin-Smith | 166/295 |
| 6,196,317 B1 | | 3/2001 | Hardy | 166/295 |
| 6,237,688 B1 | | 5/2001 | Burleson et al. | 166/281 |
| 6,258,757 B1 | | 7/2001 | Sweatman et al. | 507/219 |
| 6,356,205 B1 | * | 3/2002 | Salvo et al. | 340/853.3 |
| 6,367,549 B1 | | 4/2002 | Chatterji et al. | 166/295 |
| 6,374,925 B1 | * | 4/2002 | Elkins et al. | 175/25 |
| 6,390,208 B1 | | 5/2002 | Brookey | 175/72 |
| 6,401,818 B1 | | 6/2002 | Papanastasiou | 166/297 |
| 6,456,902 B1 | * | 9/2002 | Streetman | 700/282 |
| 2002/0092654 A1 | | 7/2002 | Coronado et al. | 166/369 |
| 2002/0112888 A1 | | 8/2002 | Lauchtenberg | 175/48 |
| 2003/0146001 A1 | * | 8/2003 | Hosie et al. | 166/369 |

FOREIGN PATENT DOCUMENTS

| | | | |
|---|---|---|---|
| WO | WO 96/32567 | 10/1996 | E21B/43/26 |
| WO | WO 01/40617 A1 | 6/2001 | E21B/43/26 |
| WO | WO 01/41617 A1 | 6/2001 | A47L/5/34 |
| WO | WO 01/98626 A1 | 12/2001 | E21B/33/13 |
| WO | WO 01/98627 A1 | 12/2001 | E21B/33/137 |

OTHER PUBLICATIONS

D. Kulakofsky et al., Remote Real Time Operations Assists in the Success of Wellbore Stability Solutions, XIV Deep Offshore Technology Conference and Exhibition, Nov. 13–15, 2002 New Orleans, Louisana.

Hong Wang et al., "The Difference between Fracture Gradient and Wellbore Pressure Containment and the Effect on Drilling Beyond Natural Pressure Limits," AADE 2003 National Technology Conference "Practical Solutions for Drilling Challenges", Apr. 1–3, 2003, Houston, Texas.

R. Sweatman et al., "New Solutions for Subsalt–Well Lost Circulation and Optimized Primary Cementing," 1999 Annual Technical Conference and Exhibition, Oct. 3–6, 1999, Houston, Texas.

(Continued)

*Primary Examiner*—David Bagnell
*Assistant Examiner*—Shane Bomar
(74) *Attorney, Agent, or Firm*—Craig W. Roddy; McAfee & Taft P.C.

(57) ABSTRACT

In accordance with a method of this invention, formation integrity problems are discovered, diagnosed and corrected in successively drilled subterranean well bore intervals. If one or more of well bore fluid outflows, formation fluid inflows or inadequate well bore pressure containment integrity are discovered in a drilled well bore interval, well logs are run and other relevant well bore data is collected in the drilled well bore interval and analyzed to provide a specific treatment using a specific pumpable sealing composition for sealing and increasing the pressure containment integrity of the well bore. Thereafter, the sealing composition is pumped into the drilled well bore interval whereby the well bore interval is sealed or the pressure containment integrity is increased, or both.

24 Claims, No Drawings

OTHER PUBLICATIONS

F. Rueda, et al., "In–Situ Reactive System Stops Lost Circulation and Underground Flow Problems in Several Southern Mexico Wells," 2000 International Petroleum Conference and Exhibition, Feb. 1–3, 2000, Villahermosa, Mexico.
SPE 24599 entitled "A New Approach to Preventing Lost Circulation While Drilling" by Giin–Fa Fuh et al., dated 1992.
SPE/IADC 37671 entitled "New Solutions to Remedy Lost Circulation, Crossflows, and Underground Blowouts" by R.E. Sweatman et al., dated 1997.
SPE 53312 entitled "Conformance–While–Drilling Technology Proposed To Optimize Drilling and Production" by R. Sweatman et al., dated 1999.
SPE 52188 entitled "Novel Approach to Borehole Stability Modeling For ERD and Deepwater Drilling" by U.A. Tare et al., dated 1999.
Paper entitled "Conformance–While–Drilling (CWD) Technology Proposed To Optimize Drilling and Production" by R. Sweatman et al., dated 1999.
SPE 56598 entitled "High Propagation Pressures In Transverse Hydraulic Fractures: Cause, Effect, and Remediation" by W.F. J. Deeg, dated 1999.
OTC 11976 entitled "New Chemical Systems and Placement Methods to Stabilize And seal Deepwater Shallow–Water Flow Zones" by Larry Eoff, dated 2000.
SPE 71368 entitled "Drilling Fluid Losses and Gains: Case Histories and Practical Solutions" by U. Tare et al., dated 2001.
SPE 10911 entitled "Fracture Design Considerations Based On Pressure Analysis" by Kenneth G. Nolte, dated 1982.
SPE 28555 entitled "Oriented Perforations—A Rock Mechanics View" by Hazim H. Abass et al., dated 1994.
STCE98–4656 entitled "Borehole Failure Resulting From Formation Integrity (Leak–Off) Testing In Upper Marine Sediments Offshore" by Andrew K. Wojtanowicz et al., dated 1998.
ETCE99–6645 entitled "Solutions Proposed For Deepwater Drilling Challenges Using New Technology For Hole–Stabilization–While–Drilling" by Ronald Sweatman et al., dated 1999.
SPE 59131 entitled "Improved Zonal Isolation Through The Use of Sealants Before Primary Cementing Operations" by Loyd E. East, Jr. et al., dated 2000.
Paper entitled "How To Choose Between Mud and Cement Inflation of Inflatable Packers" by George O. Suman, Jr. et al., dated 1995.
IADC/SPE 59132 entitled "New Cement Systems For Durable Zonal Isolation" by Le Roy–Delage S. et al., dated 2000.
SPE 20409 entitled "Theroy of Lost Circulation Pressure" by N. Morita et al., dated 1990.
SPE–IADC 67735 entitled "Lost Circulation Control: Evolving Techniques And Strategies to Reduce Downhole Mud Losses" by James R. Bruton et al., dated 2001.
SPE 68946 entitled "Formation Pressure Integrity Treatments Optimize Drilling And Completion of HTHP Production Hole Sections" by Ron Sweatman et al., dated 2001.
SPE71377 entitled "Aphron–Base Drilling Fluid" Evolving Technologies For Lost Circulation Control by C.D. Ivan et al., dated 2001.
SPE 71390 entitled "New Treatments Substantially Increase LOT/FIT Pressures to Solve Deep HTHP Drilling Challenges" by Sid Webb et al., dated 2001.
IADC/SPE 74518 entitled "Unique Crosslinking Pill In Tandem With Fracture Prediction Model Cures Circulation Losses In Deepwater Gulf Of Mexico" by Douglas E. Caughron et al., dated 2002.
AADE 01–NC–HO–42 entitled "Treatments Increase Formation Pressure Integrity In HTHP Wells" by Scott Kelley et al., dated 2001.
Paper entitled "Drill Ahead To Complete HP/HT Wells" by Scott Kelley Et al., Hart's E&P, Chemical Week Associates, New York, NY, dated 2001.
Paper entitled "Fracture Evaluation Using Pressure Diagnostics" by Sunil N. Gulrajani et al, dated 2000.
InstanSeal Brochure entitled "Novel lost circulation treatment", dated 2000.
Paper entitled "Clay/latex mixture stops lost circulation in large Carbonate fractures", by Boris Kurochkin, dated 1995.
Paper entitled "Drill ahead to complete HP/HT wells" by Scott Kelly et al., dated Sep. 2001.

* cited by examiner

METHODS OF DISCOVERING AND CORRECTING SUBTERRANEAN FORMATION INTEGRITY PROBLEMS DURING DRILLING

BACKGROUND OF THE INVENTION

1. Field of the Invention

The present invention relates to methods of discovering, diagnosing and correcting formation integrity problems in successively drilled subterranean well bore intervals.

2. Description of the Prior Art

In the drilling of wells (for example, oil and gas wells) using the rotary drilling method, drilling fluid is circulated through a drill string and drill bit and then back to the surface by way of the well bore being drilled. The drilling fluid maintains hydrostatic pressure on the subterranean formations through which the well bore is drilled to thereby prevent pressurized formation fluids from entering the well bore and circulates cuttings out of the well bore.

Once the well bore has been drilled to the desired depth, a string of pipe referred to as casing is positioned in the well bore. A hydraulic cement composition is pumped into the annular space between the walls of the well bore and the casing and allowed to set thereby forming an annular sheath of hardened substantially impermeable cement in the annulus. The cement sheath physically supports and positions the casing in the well bore and bonds the casing to the walls of the well bore whereby undesirable migration of fluids between zones or formations penetrated by the well bore is prevented.

The subterranean formations into or through which well bores are drilled often contain naturally occurring or drilling induced weak zones having low tensile strengths and/or openings such as fractures, faults and high permeability streaks through which drilling fluid is lost from the well bores or pressurized formation fluids enter the well bores. The weak zones in the well bore have low pressure containment integrity and are subject to failure as a result of the hydrostatic pressure exerted thereon by drilling fluid or other treating fluid such as hydraulic cement slurries. That is, when a well fluid such as drilling fluid or a hydraulic cement slurry is introduced into the well bore, the combination of hydrostatic and friction pressure exerted on the walls of the well bore can exceed the strength of weak zones in the well bore and cause well bore fluid outflows into the formation containing the well bore. When the formation contains induced or natural formation fractures, faults, or the like, well bore fluid outflows and/or pressurized formation fluid inflows, or both, can take place. The inflows and/or outflows make the well unstable. When a well becomes unstable, major problems such as lost circulation and blow-outs can occur which require the drilling operation to be terminated and costly remedial steps to be taken.

By way of further example, formation sands and shales can be encountered while drilling having unexpected low pressure containment integrity. Thus, at any depth during the drilling or completion of a well bore, the well bore fluid circulating densities and pressures can exceed planned or designed densities and pressures. The excess pressure exerted within the well bore can and often does exceed the subterranean formation pressure containment integrity which causes loss of well bore fluids into the formation. Such loss can lower fluid column heights in the well bore, reduce hydrostatic pressure below formation pore pressures and cause pressurized formation fluid inflow. When this happens, rig operators are often forced to prematurely set casing or run a drilling liner in the well bore making the overall cost of the well much higher than expected.

Thus, there are needs for reliable and quick methods of discovering, diagnosing and correcting formation integrity problems in well bores during drilling.

SUMMARY OF THE INVENTION

The present invention provides methods of discovering, diagnosing and correcting formation integrity problems during the drilling of successive subterranean well bore intervals. A method of the invention is comprised of the following steps. A first test is run in the well bore interval to determine if well bore fluid is being lost or if pressurized formation fluid is flowing into the well bore interval. A test is also conducted to determine the pressure containment integrity of the well bore interval. If it is determined that well bore fluid is being lost or pressurized formation fluid is flowing into the well bore interval or if it is determined that the pressure containment integrity is inadequate, or both, a pumpable sealing composition is provided for sealing the drilled well bore interval to prevent well bore fluid loss therefrom, to prevent pressurized formation fluid inflow thereinto and/or to increase the pressure containment integrity of the drilled well bore interval. The sealing composition is pumped into the drilled well bore interval to cause the drilled well bore interval to be sealed or the pressure containment integrity of the drilled well bore interval to be increased, or both. Thereafter, the next successive well bore interval is drilled, the tests are repeated and the remedial steps are repeated if necessary. The process of drilling a well bore interval, determining the integrity of the well bore interval and conducting remedial steps when necessary is repeated until the well bore has reached total depth. Thereafter the well bore is completed in the normal manner without encountering additional well bore integrity problems.

When it is determined that well bore fluid is being lost or pressurized fluid is flowing into a drilled well bore interval or that the pressure containment integrity of the well bore interval is inadequate, well logs and other relevant well bore data are collected in the drilled well bore interval to diagnose the cause and extent of the well bore fluid loss, the pressurized formation fluid inflow or the inadequate pressure integrity containment. In a preferred technique, the collection of the relevant well data in the drilled well bore interval is accomplished in real time and the real time data is transmitted to a location where a specific treatment using a specific pumpable sealing composition is determined. Thereafter, the specific pumpable sealing composition is provided at the well site and the sealing composition is pumped into the drilled well bore interval.

The objects, features and advantages of the present invention will be readily apparent to those skilled in the art upon a reading of the description of preferred embodiments which follows.

DESCRIPTION OF PREFERRED EMBODIMENTS

In the drilling of wells, subterranean zones are often encountered which contain high incidences of weak zones, natural fractures, faults, high permeability streaks and the like through which well bore fluid outflows and pressurized formation fluid inflows can take place. As a result, drilling fluid circulation is sometimes lost which requires termination of the drilling operation. In addition to lost circulation, pressurized fluid inflows are often encountered which cause cross-flows or underground blow-outs whereby formation fluids flow into the well bore. These problems which may be undetectable at the surface often force the discontinuance of drilling operations and the implementation of remedial procedures that are of long duration and high cost.

A variety of methods and compositions have been developed and used for dealing with the above described problems. Unfortunately those methods and compositions are often unsatisfactory. Even when successful, adequate increases in the pressure containment integrity of the well bore are often not achieved. Prior to the present invention there has not been an effective technique available for discovering, diagnosing and correcting subterranean formation integrity problems of the types described above during the drilling of the well bore.

In order to prevent the high cost and down time associated with remedial procedures to restore lost circulation or solve other well bore problems, drilling rig operators are often forced to divert from their initial drilling plan. For example, the rig operators are frequently required to prematurely set casing in order to avoid well bore fluid outflows, pressurized formation fluid inflows and pressure containment integrity problems. These measures increase the cost of well construction, increase the time to completion and may also limit the well productivity due to restricted pipe diameters, the inability to reach desired reservoir depths and the like.

The methods of the present invention allow rig operators to discover, diagnose and correct formation integrity problems in successively drilled subterranean well bore intervals. That is, after drilling each well bore interval having a length in the range of from about 200 feet to about 5,000 feet, the drilling is temporarily stopped while tests are run and well log and other relevant well bore data is collected. If the test results and collected data indicate that one or more problems exist in the drilled well bore interval, remedial steps are taken to correct the problems after which the next well bore interval is drilled, tested, data collected, etc. This process of well bore interval drilling and discovering, diagnosing, and correcting formation integrity problems in each well bore interval is continued until the total well bore depth is reached. Thereafter, the well bore can be completed and placed on production without the occurrence of problems associated with formation integrity.

A method of this invention for discovering, disclosing and correcting formation integrity problems in successively drilled subterranean well bore intervals is comprised of the steps of: (a) determining if well bore fluid is being lost from each drilled well bore interval or if pressurized formation fluid is flowing into each well bore interval, or both; (b) determining the pressure containment integrity of each well bore interval; (c) if it is determined that well bore fluid is being lost from a well bore interval or pressurized formation fluid is flowing into the well bore interval, or both, in step (a) or if it is determined that the pressure containment integrity is inadequate in step (b), providing a pumpable sealing composition for sealing the drilled well bore interval to prevent well bore fluid loss therefrom or pressurized formation fluid inflow thereinto or to increase the pressure containment integrity of the drilled well bore interval; and (d) pumping the sealing composition into the drilled well bore interval to cause the drilled well bore interval to be sealed or the pressure containment integrity of the drilled well bore interval to be increased, or both.

Before beginning the well bore drilling process, all well log data and other relevant well data relating to previous wells drilled in the area are studied and reviewed to determine problem areas that may be encountered and possible solutions for correcting the problems upon commencing the drilling of the new well bore.

After drilling the first well bore interval in accordance with the above described method, drilling is terminated and step (a) is conducted. That is, a test is conducted in the drilled well bore interval to determine if well bore fluid is being lost or if pressurized formation fluid is flowing into the well bore interval, or both. This test can be conducted by circulating a well bore fluid such as the drilling fluid in the well bore through the drilled well bore interval for a period of time sufficient to determine if the quantity of the well bore fluid being circulated decreases due to well bore fluid being lost from the drilled well bore interval or increases due to formation fluid which can be liquid or gas flowing into the well bore interval.

If the test conducted in accordance with step (a) is negative, the pressure containment integrity of the drilled well bore interval is determined in accordance with step (b). That is, a well bore fluid such as drilling fluid in the drilled well bore interval is increased in density or pressurized to an equivalent well bore fluid weight greater than or equal to the maximum hydrostatic pressure and friction pressure level expected to be exerted in the drilled well bore interval to determine if the pressure containment integrity of the drilled well bore interval is inadequate. That is, if the well bore fluid in the drilled well bore interval leaks off into the subterranean formation containing the well bore interval at the maximum equivalent well bore fluid weight, the pressure containment integrity of the well bore interval is inadequate. If the tests conducted in steps (a) and (b) are negative, i.e., if it is determined that no well bore fluid is being lost, no formation into the well bore and the pressure containment integrity is adequate, drilling is resumed and the next well bore interval is drilled.

If, on the other hand, formation integrity problems are found by conducting steps (a) and (b) in the first well bore interval, steps (c) and (d) are conducted. However, before conducting steps (c) and (d), i.e., before providing the pumpable sealing composition and pumping it into the drilled well bore interval, electronic logs are run and all other relevant well bore data is collected in and relating to the drilled well bore interval. The collected data is analyzed in order to determine the extent of the weak zones and openings in the drilled well bore interval, the type of sealing composition required and the volume of the composition required. Examples of the data that can be collected and used include, but are not limited to, analyzing leak-off test data, electronic log data, formation cuttings, chemical composition analyses, and various simulation models well known to those skilled in the art. In addition to the type and volume of sealing composition required, the analysis determines the sealing composition placement parameters such as rates, pressures, volumes, time periods, densities, sealant properties, etc.

The sealing composition provided in accordance with step (c) of the method of this invention must seal the drilled well bore interval to prevent well bore fluid loss therefrom or fluid inflow thereinto or increase the pressure containment integrity of the drilled well bore interval, or both.

An example of a suitable sealing composition that can be used reacts with water in the drilled well bore interval and is basically comprised of oil, a hydratable polymer, an organophillic clay and a water swellable clay. This sealing composition is described in detail in U.S. Pat. No. 6,060,434 issued to Sweatman et al. on May 9, 2000 which is incorporated herein by reference thereto.

The placement of the above described sealing composition can be controlled in a manner whereby portions of the sealing composition are continuously converted to sealing masses that are successively diverted into permeable portions of the drilled well bore interval until all of the permeable portions are sealed. This is accomplished by pumping the sealing composition through one or more openings at the end of a string of drill pipe into the drilled well bore interval at a flow rate relative to the well bore fluids therein whereby the sealing composition flows through the well bore fluids with a minimum of mixing therewith and whereby portions of the sealing composition are converted to sealing masses as the sealing composition flows through the interval. The sealing masses are successively diverted into and seal the weak zones and other permeable portions of the well bore interval through which well bore fluids are flowing out of the zone thereby allowing the hydrostatic pressure exerted in the interval to increase until all of the permeable outflow portions in the interval are sealed. This method of utilizing a sealing composition is described in detail in U.S. Pat. No. 5,913,364 to Sweatman issued on Jun. 22, 1999 which is incorporated herein by reference thereto.

Another pumpable sealing composition which can be used reacts with oil in the drilled well bore interval and is basically comprised of water, an aqueous rubber latex, an organophillic clay, sodium carbonate and a hydratable polymer. This sealing composition is described in detail in U.S. Pat. No. 6,258,757 B1 issued to Sweatman et al. on Jul. 10, 2001 and is also incorporated herein by reference thereto.

As is well understood by those skilled in the art, a variety of other pumpable sealing compositions can be utilized in accordance with this invention to terminate well bore weak zones and/or openings allowing well bore fluid outflows, pressurized formation fluid inflows, well bore inadequate pressure containment integrity, and the like.

As will be further understood by those skilled in the art, spacers can be pumped into the drilled well bore interval in front of and/or behind the sealing composition utilized to prevent the sealing composition from reacting and solidifying before it reaches the weak zones and/or openings to be sealed. The spacers can have densities equal to or less than the density of the well fluid and the spacers can be chemically inhibited to prevent formation damage.

After the sealing composition has been placed in the drilled well bore interval, the well fluid containing sealing composition masses that have not been diverted into weak zones or openings in the formation being sealed is removed from the well bore. Thereafter, the drilled well bore interval can again be tested for pressure containment integrity to insure that the well bore interval was properly sealed. In addition, additional electric log data and other data can be collected to determine if the well bore interval has been satisfactorily sealed. Thereafter, drilling is commenced, another drilled well bore interval is produced and the above described tests and procedures implemented as necessary.

Another method of this invention for discovering, diagnosing and correcting formation integrity problems in successively drilled subterranean well bore intervals comprises the steps of: (a) drilling a first well bore interval; (b) determining if well bore fluid is being lost from the first well bore interval or if pressurized formation fluid is flowing into the first well bore interval; (c) determining the pressure containment integrity of the first well bore interval; (d) if it is determined that well bore fluid is being lost from or pressurized formation fluid is flowing into the first well bore interval in step (b) or if it is determined that the pressure containment integrity is inadequate in the first well bore interval in step (c), or both, performing the additional steps of: (1) running well bore logs and collecting other relevant well bore data in the first well bore interval in real time, (2) transmitting all real time data collected to a location where a specific treatment using a specific pumpable sealing composition is determined, (3) providing the specific pumpable sealing composition at the well site, and (4) performing the specific treatment including pumping the sealing composition into the first well bore interval to cause the first well bore interval to be sealed or the pressure containment integrity to be increased, or both; and (e) repeating steps (a), (b), (c) and (d) for each additional well bore interval drilled until the total well bore depth is reached.

The above described method differs from the method previously described primarily in step (d) which calls for the relevant well bore data to be in real time, transmitting the real time data to a location where a specific treatment using a specific pumpable sealing composition is determined, providing the specific pumpable sealing composition at the well site and performing the specific treatment including pumping the sealing composition into the well bore interval to cause the well bore interval to be sealed or the pressure containment integrity to be increased or both.

As is well understood by those skilled in the art, oil and gas wells are often drilled at remote onshore well sites and offshore well sites. It is difficult for the personnel at the well site to analyze the data and to determine the specific treatment required using a specific pumpable sealing composition. In accordance with the method of this invention, the collected data is transmitted in real time to a remote location where the necessary computers and other equipment as well as trained personnel are located. The trained personnel can quickly determine the specific treatment required including placement parameters such as rates, pressures, volumes, time periods, densities, sealing properties and the like. Consequently, a specific treatment using a specific pumpable sealing composition is quickly determined and transmitted to the personnel at the well site so that the proper sealing composition can be quickly provided and the treatment can be carried out.

Thus the methods of the present invention avoid the various problems encountered by rig operators heretofore. The methods allow formation integrity problems to be discovered, diagnosed and corrected during the drilling of the well bore so that when total depth is achieved, the resulting well bore is devoid of weak zones and openings and has adequate pressure containment integrity to permit well completion procedures to be carried out without the occurrence of costly and time consuming formation integrity problems.

Thus, the present invention is well adapted to carry out the objects and attain the benefits and advantages mentioned as well as those which are inherent therein. While numerous changes to the methods can be made by those skilled in the art, such changes are encompassed within the spirit of this invention as defined by the appended claims.

What is claimed is:

1. A method of discovering, diagnosing and correcting formation integrity problems in successively drilled subterranean well bore intervals comprising the steps of:

(a) drilling a first well bore interval;

(b) determining if well bore fluid is being lost from each drilled well bore interval or if pressurized formation fluid is flowing into said drilled well bore interval, or both by circulating a well bore fluid through said drilled well bore interval for a period of time sufficient to determine if the quantity of said well bore fluid being circulated decreases due to well bore fluid outflow from said drilled well bore interval or increases due to pressurized formation fluid inflow into said drilled well bore interval;

(c) determining the pressure containment integrity of said drilled well bore interval;

(d) if it is determined that well bore fluid is being lost from said drilled well bore interval or pressurized formation fluid is flowing into said well bore interval, or both, in step (b) or if it is determined that said pressure containment integrity is inadequate in step (c), providing a pumpable sealing composition for sealing said drilled well bore interval to prevent well bore fluid outflow therefrom, to prevent pressurized formation fluid inflow thereinto or to increase the pressure containment integrity of said drilled well bore interval;

(e) pumping said sealing composition into said drilled well bore interval to cause said drilled well bore interval to be sealed or the pressure containment integrity of said drilled well bore interval to be increased, or both;

(f) drilling a second well bore interval; and (g) repeating steps (b), (c), (d) and (e) for the second drilled well bore interval.

2. The method of claim 1 wherein said well bore fluid is drilling fluid.

3. The method of claim 1 wherein if it is determined that well bore fluid outflow from said drilled well bore interval is occurring or pressurized formation fluid inflow into said drilled well bore interval is occurring, or both, step (b) further comprises analyzing well logs and other relevant well bore data collected in said drilled well bore interval to diagnose the cause and extent of said well bore fluid outflow or formation fluid inflow, or both.

4. The method of claim 3 wherein said well logs are run and said other relevant data is collected in real time and the real time data is transmitted to a remote location wherein the specific pumpable sealing composition to utilize is determined.

5. The method of claim 1 wherein step (c) comprises increasing the density of or pressure exerted on a well bore fluid in said drilled well bore interval to an equivalent well bore fluid weight greater than or equal to the maximum hydrostatic pressure and friction pressure level to be exerted in said drilled well bore interval to determine if leak off occurs and the pressure containment integrity of said drilled well bore interval is inadequate.

6. The method of claim 5 wherein said well bore fluid is drilling fluid.

7. The method of claim 5 wherein if the pressure containment integrity is inadequate, step (c) further comprises analyzing well logs and other relevant well bore data collected in said drilled well bore interval to diagnose the cause and extent of said inadequate pressure integrity containment.

8. The method of claim 7 wherein said well logs are run and said other relevant data is collected in real time and the real time data is transmitted to a remote location wherein the specific pumpable sealing composition to utilize is determined.

9. The method of claim 1 wherein when a pumpable sealing composition is provided in step (d), the pumpable sealing composition has the properties of rapidly converting into high viscosity sealing masses upon commingling and reacting with well bore fluids which are diverted into, seal and strengthen weak zones and openings in the drilled well bore interval through which well bore fluid outflows or pressurized formation fluid inflows into said drilled well bore interval.

10. The method of claim 1 wherein said pumpable sealing composition reacts with water in said drilled well bore interval and is comprised of oil, a hydratable polymer, an organophillic clay and a water swellable clay.

11. The method of claim 1 wherein said pumpable sealing composition reacts with oil in said drilled well bore interval and is comprised of water, an aqueous rubber latex, an organophillic clay, sodium carbonate and a hydratable polymer.

12. A method of correcting a formation integrity problem in a drilled subterranean well bore interval comprising the steps of:

(a) determining the natural pressure containment integrity of said drilled well bore interval;

(b) providing a pumpable sealing composition for increasing the pressure containment integrity of said drilled well bore interval; and (c) pumping said sealing composition into said drilled well bore interval to cause the pressure containment integrity of said drilled well bore interval to be increased to a value greater than the natural pressure containment integrity of said interval; and (d) after step (c), confirming that the pressure containment integrity of said drilled well bore interval has been increased to a value greater than the natural pressure containment integrity of said interval by increasing the density of or pressure exerted on a well bore fluid in said drilled well bore interval to an equivalent well bore fluid weight greater than or equal to the maximum hydrostatic pressure and friction pressure level to be exerted in said drilled well bore interval and determining if leak off occurs.

13. The method of claim 12 wherein step (a) further comprises analyzing well logs and other relevant well bore data collected in said drilled well bore interval to diagnose the cause and extent of said formation integrity problem.

14. The method of claim 13 wherein said well logs are run and said other relevant data is collected in real time and the real time data is transmitted to a remote location wherein the specific pumpable sealing composition to utilize is determined.

15. The method of claim 12 wherein the pumpable sealing composition has the properties of rapidly converting into high viscosity sealing masses upon commingling and reacting with well bore fluids which are diverted into, seal and strengthen weak zones and openings in the drilled well bore interval.

16. The method of claim 15 wherein said pumpable sealing composition reacts with water in said drilled well bore interval and is comprised of oil, a hydratable polymer, an organophillic clay, and a swellable clay.

17. The method of claim 15 wherein said pumpable sealing composition reacts with oil in said drilled well bore interval and is comprised of water, an aqueous rubber latex, and organophillic clay, sodium carbonate and a hydratable polymer.

18. A method of discovering, diagnosing and correcting formation integrity problems in successively drilled subterranean well bore intervals comprising the steps of:

(a) drilling a first well bore interval;

(b) determining if well bore fluid is being lost from said drilled well bore interval or if pressurized formation fluid is flowing into said drilled well bore interval, or both by circulating a well bore fluid through said drilled well bore interval for a period of time sufficient to determine if the quantity of said well bore fluid being circulated decreases due to well bore fluid outflow from said drilled well bore interval or increases due to pressurized formation fluid inflow into said drilled well bore interval;

(c) determining the pressure containment integrity of said drilled well bore interval;

(d) if it is determined that well bore fluid is being lost from said drilled well bore interval or pressurized formation fluid is flowing into said drilled well bore interval, or both, in step (b) or if it is determined that said pressure containment integrity is inadequate in step (c), providing a pumpable sealing composition for increasing the pressure containment integrity of said drilled well bore interval and, if necessary, sealing said drilled well bore interval to prevent well bore fluid outflow therefrom or pressurized formation fluid inflow thereinto;

(e) pumping said sealing composition into said drilled well bore interval to cause the pressure containment integrity of said drilled well bore interval to be increased to a value greater than the natural fracture pressure of said interval and, if necessary, to cause said drilled well bore interval to be sealed;

(f) drilling a second well bore interval; and (g) repeating steps (b), (c), (d) and (e) for the next drilled well bore interval.

19. The method of claim 18 wherein if it is determined that well bore fluid outflow from said drilled well bore interval is occurring or pressurized formation fluid inflow into said drilled well bore interval is occurring, or both, step (b) further comprises analyzing well logs and other relevant well bore data collected in said drilled well bore interval to diagnose the cause and extent of said well bore fluid outflow or formation fluid inflow, or both.

20. The method of claim 19 wherein said well logs are run and said other relevant data is collected in real time and the real time data is transmitted to a remote location wherein the specific pumpable sealing composition to utilize is determined.

21. The method of claim 18 wherein step (c) comprises increasing the density of or pressure exerted on a well bore fluid in said drilled well bore interval to an equivalent well bore fluid weight greater than or equal to the maximum hydrostatic pressure and friction pressure level to be exerted in said drilled well bore interval to determine if leak off occurs and the pressure containment integrity of said drilled well bore interval is inadequate.

22. The method of claim 21 wherein if the pressure containment integrity is inadequate, step (c) further comprises analyzing well logs and other relevant well bore data collected in said drilled well bore interval to diagnose the cause and extent of said inadequate pressure integrity containment.

23. The method of claim 22 wherein said well logs are run and said other relevant data is collected in real time and the real time data is transmitted to a remote location wherein the specific pumpable sealing composition to utilize is determined.

24. The method of claim 18 wherein when a pumpable sealing composition is provided in step (d), the pumpable sealing composition has the properties of rapidly converting into high viscosity sealing masses upon commingling and reacting with well bore fluids which are diverted into, seal and strengthen weak zones and openings in the drilled well bore interval through which well bore fluid outflows or pressurized formation fluid inflows into said drilled well bore interval.

* * * * *